United States Patent [19]

Abreu

[11] 4,449,808

[45] May 22, 1984

[54] ELECTROSTATIC DETACK APPARATUS AND METHOD

[75] Inventor: Cristian O. Abreu, Rochester, N.Y.

[73] Assignee: Xerox Corporation, Stamford, Conn.

[21] Appl. No.: 385,624

[22] Filed: Jun. 7, 1982

[51] Int. Cl.[3] ..... G03G 15/00

[52] U.S. Cl. ..... 355/3 TR; 355/3 CH; 355/14 CH; 250/324; 250/325; 361/229; 361/230; 430/35

[58] Field of Search ..... 250/324, 325, 326; 361/229, 230, 225; 355/3 TR, 3 CH, 14 CH, 3 SH, 14 SH; 430/126, 33, 35, 48

[56] References Cited

U.S. PATENT DOCUMENTS

| | | | |
|---|---|---|---|
| 2,836,725 | 5/1958 | Vyverberg | 250/49.5 |
| 2,879,395 | 3/1959 | Walkup | 250/49.5 |
| 3,396,308 | 8/1968 | Whitmore | 361/229 X |
| 3,813,548 | 5/1974 | Silverberg | 250/324 |
| 3,921,042 | 11/1975 | Shenoy | 361/229 |
| 3,996,466 | 12/1976 | Davis | 250/325 |
| 4,086,650 | 4/1978 | Davis et al. | 361/229 |
| 4,112,299 | 9/1978 | Davis | 250/326 |
| 4,190,348 | 2/1980 | Friday | 250/325 X |
| 4,265,990 | 5/1981 | Stolka et al. | 430/59 |

*Primary Examiner*—A. C. Prescott

[57] ABSTRACT

In a xerographic reproduction machine there is provided apparatus for partially neutralizing charge on the backside of a copy sheet electrostatically adhered to a photoconductive surface. Included in the apparatus is a conductive wire having a relatively thick insulative outer coating which is sufficiently thick that with an a.c. voltage applied to the conductive wire there is substantially no net d.c. current flow from the wire in the absence of an external electrostatic field. Such a construction of wire and outer coating is known as a dicorotron electrode. A net positive current flows from the wire to the back of the paper when an external electrostatic field is established between the conductive shield and the copy sheet by moving said copy sheet with a positive voltage on its backside past the conductive wire. A resistor connecting a conductive shield positioned to the side of the conductive wire opposite the backside of the copy sheet establishes a bias voltage for the shield as a result of current flow from the conductive wire to the shield and through the resistor.

4 Claims, 1 Drawing Figure

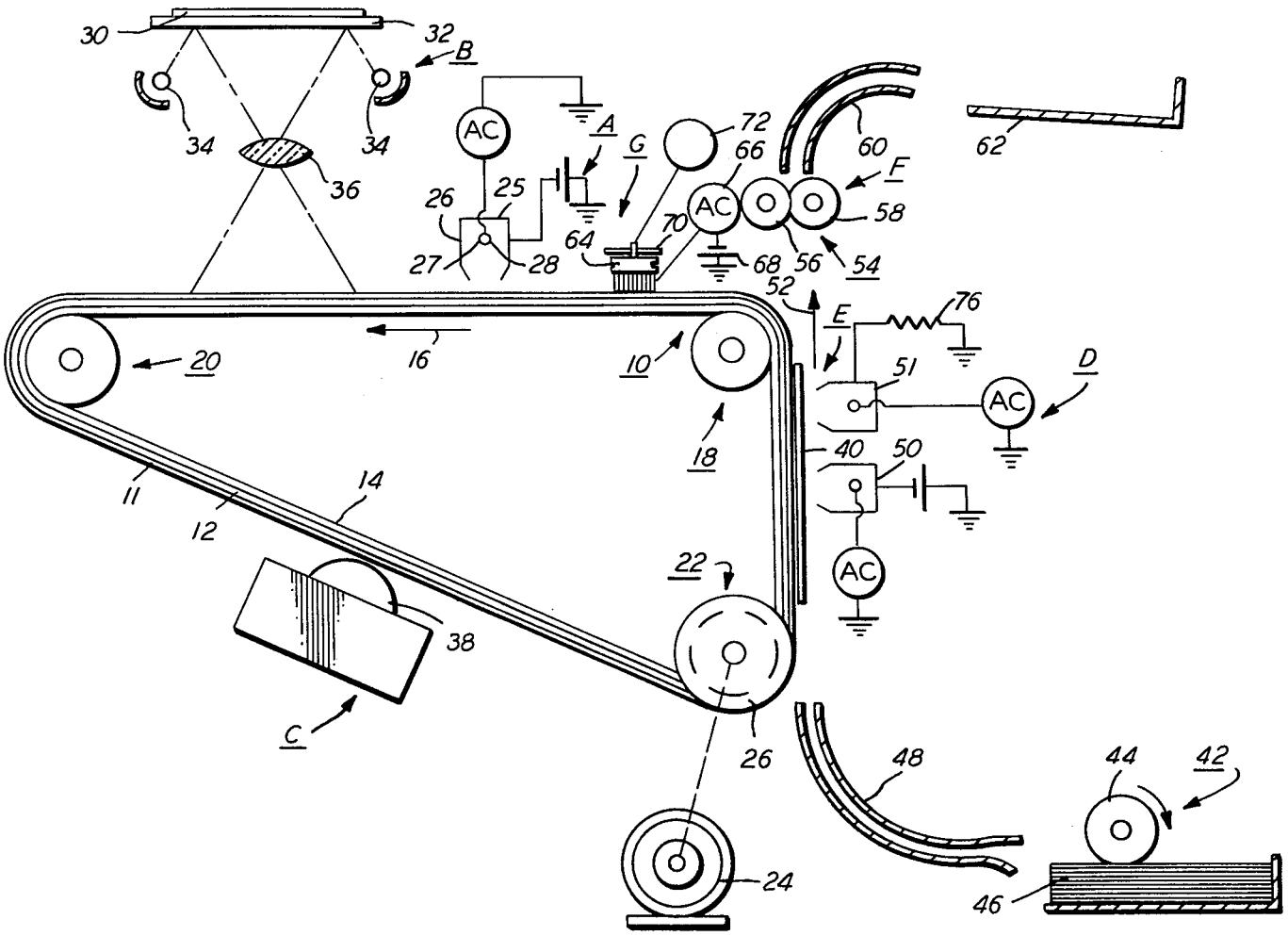
AC
AC
AC
AC
A
B
C
D
E
F
G
10
11
12
14
16
18
20
22
24
25
26
27
28
30
32
34
36
38
40
42
44
46
48
50
51
52
54
56
58
60
62
64
66
68
70
72
76

ELECTROSTATIC DETACK APPARATUS AND METHOD

BACKGROUND OF THE INVENTION

The present invention relates to corona generating devices and more particularly to such a device which is utilized for partially neutralizing electrostatic charges on a surface utilized in the xerographic process.

Generally, the process of xerographic or electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, it is developed by bringing a developer mixture into contact therewith. This forms a powder image on the photoconductive member which is subsequently transferred to a copy sheet. Finally, the powder image is heated to permanently affix it to the copy sheet in image configuration.

Corona generating devices are commonly used for charging the photoconductive member and for effecting transfer of the toner images to the copy sheet. During the transfer process the backside of the copy sheets is charged to a suitable level and polarity to effect transfer of the images to the copy sheet. By virtue of the charge on the backside of the copy sheet a charge of opposite polarity is induced on the photoconductive member in the non-image areas thereby creating an electrostatic bond between the copy sheet and the photoconductive member.

To facilitate separation of the copy sheet from the photoconductive member, it is desirable to partially neutralize the aforementioned charges on the backside of the copy sheet to thereby remove a part of the electrostatic bond caused thereby. Corona devices have also been employed for this purpose. The process by which this is accomplished has come to be known as electrostatic detacking. Another application is that of "preclean" where the toner charge and/or photoreceptor charge may need to be neutralized.

The conventional form of corona discharge device used in reproduction systems of the above type whether for charging, transfer or detack is shown generally in U.S. Pat. No. 2,836,725 in which a conductive corona electrode in the form of an elongated wire is connected to a corona generating d.c. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an a.c. corona generating potential is applied to the conductive wire electrode and a d.c. potential is applied to the conductive shield partially surrounding the electrode to regulate the flow of ions from the electrode to the surface to be charged.

A problem associated with conventional corona discharge devices employing a conductive wire is a result of the fact that corona glow is associated with a region of high chemical reactivity where chemical compounds are synthesized from machine air, which results in chemical growths being built up on the surface of the wire. These chemical growths, after a prolonged period of operation, degrade the performance of the corona device. Since free oxygen and ozone are produced in the corona region the corona electrode must of necessity be highly oxidation resistant. The above problem of chemical growth build-up on the wire has been addressed by the provision of wire materials which are less subject to chemical attack. While this has reduced the problem, such materials have substantially increased the cost of corona devices.

Prior art devices utilizing a bare wire when operated in an a.c. mode with the shield grounded, do not completely neutralize a charged surface. The prior art corona device delivers a net negative d.c. current ($-Ip$) to the collecting surface when that surface is completely neutralized ($Vp=0$). Another problem which "bare" wire devices is that of lengthwise current non-uniformity.

The above characteristic of prior art a.c. corona devices results from the greater mobility of negative ions. This phenomenon is well known in the art. The use of d.c. power supplies for biasing the shield of such corona devices has been employed to make them operational in a desired manner. While such external biasing arrangements allow for the desired operation of an a.c. corona device with the output of corona generators operated in this manner there is a high probability of change due to ambient conditions such as temperature and humidity and contamination conditions due to toner accumulation.

Another type of corona generating device considered more suitable for the xerographic charging functions is the dicorotron electrode which is the conbination of a conductive wire and a relatively thick dielectric outer coating as disclosed in U.S. Pat. No. 4,086,650. The dicorotron is not as susceptible to the aforementioned shortcomings as is the bare wire corotron. The thickness of the dielectric is such that with an a.c. voltage applied to the dicorotron electrode and with the shield and surface to be exposed to corona at the same potential there is substantially no net d.c. current flow between the wire and the surface nor between the wire and the conductive shield forming a part of the corona generating device. However, if an electrostatic field is created between the shield and the surface as by applying a bias to the shield or placing a charge on the surface then there would be a net d.c. current flow to the surface and to the shield.

Another feature of the dicorotron is that unlike the bare wire corotron the current flowing between the dicorotron wire and the surface to be exposed to corona is equal in magntitude and opposite in polarity to the current flowing between the dicorotron wire and the conductive shield.

In the case of the bare wire corotron with an a.c. voltage applied, the two currents are of the same polarity and usually of different magnitudes since it is desirable to have more current flowing to the surface being exposed to corona. To obtain greater current flow to the photoconductive surface when used for charging a current limiting resistor has been used as disclosed in U.S. Pat. No. 3,813,548 issued in the name of Morton Silverberg.

The dicorotron, therefore, is particularly suited for partially neutralizing the charge place on the backside of the copy sheet during transfer. This is because the voltage on the backside of the copy sheet when it and the photoconductive surface are moved past the detack dicorotron creates an electrostatic field between the shield and the copy sheet which causes a net d.c. current to flow to the backside of the copy sheet thereby neutralizing part of the charge thereon.

As may be appreciated, the voltage level on the backside of the copy sheet will not be a constant value due to the variety of operating conditions to which a xerographic machine is subjected. Such machines must be capable of handling various weights of paper under various atmospheric conditions. The thickness of the paper which is a function of its weight and the paper's resistivity which is a function of atmospheric conditions and the type of paper are factors which alter the voltage level that appears on the backside of the copy sheet after transfer. Such variations in copy sheet voltage levels have been handled in prior art devices by the provision of costly and complex feedback circuits for sensing the voltage levels on the backside of the copy sheet and using the sensed value to derive a signal which is used to charge the power output of the shield bias power supply.

SUMMARY OF THE INVENTION

In accordance with the present invention, generation of the desired neutralizing current is accomplished by the provision of a suitable impedance device such as a resistor which connects the conductive shield to ground. Thus, when the charged copy sheet is moved in the vicinity of the detack decorotron an electrostatic field is created which causes current to flow through the shield resistor thereby establishing a suitable biasing voltage for the shield. The magnitude of the bias voltage is a function of the current flow which, in turn, is a function of the magnitude of the charge level on the backside of the copy sheet. Accordingly, if there is a large charge on the copy sheet there will be a large bias resulting in a greater flow of current to copy the sheet to neutralize a greater amount of the charge. Contrawise, if the voltage level on the copy sheet is lower a smaller shield bias is created, therefore, a smaller current flows to the copy sheet and neutralizes a lesser amount of charge. By the use of a resistor having a proper value, a current is developed sufficient to neutralize enough of the charge to facilitate stripping of the copy sheets from the photoconductive surface. This arrangement is effective for a range of voltages that appear on the backside of the copy sheet as the result of transfer. The neutralization of part of the charge on the sheet also prevents image disturbance downstream of the detack station should the paper contact parts of the machine resulting in charge leakage from the paper.

BRIEF DESCRIPTION OF THE DRAWING

The FIGURE is a schematic illustration of a xerographic machine incorporating the invention.

DETAILED DESCRIPTION OF THE PREFERRED EMBODIMENT

For a general understanding of the features of the present invention, a description thereof will be made with reference to the drawing. The Figure schematically depicts the various components of an illustrative electrophotographic printing machine incorporating the apparatus and method of the present invention.

Inasmuch as the art of electrophotographic printing is well known, the various processing stations employed in the printing machine illustrated in the FIGURE will be described only briefly.

As shown in the Figure, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive.

Belt 10 is maintained in tension by a a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to the Figure, initially a portion of belt 10 passes through charging station A. At charging station A, a corona device, indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow.

Next, the charged portion of photoconductive belt is advanced through exposure station B. At exposure station B, an original document 30 is positioned face down upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is effected by the application of a suitable corona generating voltage and proper bias.

Subsequent to transfer the image sheet moves past a detack corona generating device 51 positioned at a detack station E. At the detack station the charges placed on the backside of the copy sheet during transfer are partially neutralized. The partial neutralization of the charges on the backside of the copy sheet thereby reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly, indicated generally by the reference numeral 54, which permanently affixes the transferred toner powder images to sheet 40. Preferably, fuser assembly 54 includes a heated fuser roller 56 adapted to be pressure engaged with a backup roller 58. Sheet 40 passes between fuser roller 56 and backup roller 58 with the toner powder images contacting fuser foller 56. In this manner, the toner powder image is permanently affixed to sheet 40. After fusing chute 60 guides the advancing sheet 40 to catch tray 62 for removal from the printing machine by the operator.

At an image disturbing station G, there is provided an electrically conductive brush 64 to which an a.c. voltage is supplied from a source 66. A d.c. bias 68 is applied to the a.c. source 66. The brush is adapted to be cyclically moved in a direction substantially perpendicular to the direction of movement of the photoconductive belt 10. Such movement may be accomplished by means of a cam structure 70 operatively connected to a motor 72.

In one operative embodiment, the a.c. voltage was 1500 volts at 250 Hz and the d.c. bias voltage was equal to a negative 250 volts while the nechanical frequency of the brush was 1800 cycles per minute. With a brush to belt interference of 0.10 inch it is desirable for optimum results that the relative speed between the belt and brush is such as to permit the brush to make two complete oscillations during the time a point on the photoconductive belt moves through the nip (i.e. area of contact between the brush and belt) formed between the brush and the belt.

During operation of the brush structure, the toner forming the residual images remaining on the photoconductive belt after the transfer step is redistributed such that it can be removed by the magnetic brush developer roller 38 as the redistributed toner moves through the development station C.

The dicorotron structure is the same for all of the corona devices but the voltages and biases and methods of applying them are not necessarily the same. In fact, the detack corona device 51 is operated quite differently from othe other corona devices. An a.c. voltage is applied to the dicorotron electrode with the shield connected to ground through an impedance such as a resistor 76. With such an arrangement, when the photoconductive surface with the sheet 40 adhered thereto through electrostatic bonds resulting from the transfer operation, moves through the detack station, the voltage contained on the backside of the sheet 40 establishes an electrostatic field between the shield and the copy sheet. This field causes current to flow between the dicorotron electrode and the backside of the copy sheet and between the dicorotron electrode and the shield. Thus, a current flows through the resistor 76 which developes a voltage across it which is the desired shield bias voltage. A suitable value for the resistance of resistor 76 is 5–50 megohm depending on process speed. This resistance range results in positive current flow to the copy sheet on the order of 5–20 microamperes depending on such factors as paper weight and resistivity.

The corona wire 27 may be supported in cinventional fashion at the ends thereof by insulating end blocks (not shown) mounted within the ends of shield structure 26. The wire may be made of any conventional conductive filament material such as stainless steel, gold, aluminum, copper, tungsten, platinum or the like. The diameter of the wire 11 is not critical and may vary typically between 0.5–15 mil and preferably is about 3–6 mils.

Any suitable dielectric material may be employed as the coating 28 which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating used in the corona device of the invention is such that when an a.c. voltage is applied to the wire and with the photoconductive surface and the shield at the same potential substantially no conduction current or d.c. charging current is permitted therethrough. Typically, the thickness is such that the combined wire and dielectric thickness falls in the range from 5–30 mil with a typical dielectric thickness of 1–10 mil. Glasses with dielectric breakdown strengths above 5 KV/mm have been found by experiment to perform satisfactorily as the dielectric coating material. The glass coating selected should be free of voids and inclusions and make good contact with or wet the wire on which it is deposited. Other possible coatings are ceramic materials such as alumina, zirconia, boron nitride, beryllium oxide and silicon nitride. Organic dielectrics which are sufficiently stable in corona may also be used.

I claim:

1. In a xerographic reproduction machine, apparatus for partially neutralizing charge on the backside of a copy sheet electrostically adhered to a photoconductive surface, said apparatus comprising:

a dicorotron electrode including a conductive wire having an insulative outer coating, said coating being sufficiently thick that with an a.c. voltage applied to said conductive wire there is substantially no net d.c. current flow from the wire in the absence of an external electrostatic field;

a conductive shield;

a resistor operatively connecting said shield to ground; and means for moving said copy sheet with charge on its backside past said dicorotron electrode whereby an external electrostatic field is established between said conductive shield and said copy sheet thereby causing a net d.c. current to flow from said dicorotron electrode to said copy sheet and through said resistor via said shield whereby the voltage drop across said resistor provides a suitable bias voltage for said shield.

2. Apparatus according to claim 2 wherein the resistance value of said resistor is such that between 5–20 microamperes of current flows to said copy sheet.

3. A method of partially neutralizing the charges on the backside of a copy sheet which is electrostatically adhered to a photoconductive surface, said method comprising the steps of:

supporting a dicorotron electrode coupled to an a.c. voltage source adjacent a conductive shield connected to ground and supporting it such that said photoconductive surface with said copy sheet containing negative charges on the backside thereof can be moved therepast;

coupling said conductive shield to ground through a resistor;

coupling an a.c. voltage to said dicorotron electrode; and moving said photoconductive surface with said copy sheet containing negative charges past said dircorotron electrode whereby a net positive current flows from said electrode to said copy sheet.

4. A method of partially neutralizing the charges on the backside of a copy sheet which is electrostatically adhered to a photoconductive surface, said method comprising the steps of:

supporting a dicorotron electrode coupled to an a.c. voltage source adjacent a conductive shield connected to ground and supporting it such that said photoconductive surface with said copy sheet containing negative charges on the backside thereof can be moved therepast to thereby cause current to flow from said electrode;

coupling an a.c. voltage to said dicorotron electrode; and modifying said current flow by connecting said conductive shield to ground via a resistor to thereby establish a bias voltage for said shield.

* * * * *